US008356568B1

(12) United States Patent
Chinn

(10) Patent No.: US 8,356,568 B1
(45) Date of Patent: Jan. 22, 2013

(54) TOE-RAIL MOUNTED BOARDING LADDER FOR SAILBOATS

(76) Inventor: Clayton D. Chinn, Oakland, CA (US)

( * ) Notice: Subject to any disclaimer, the term of this patent is extended or adjusted under 35 U.S.C. 154(b) by 146 days.

(21) Appl. No.: 12/927,390

(22) Filed: Nov. 12, 2010

(51) Int. Cl.
*B63B 17/00* (2006.01)

(52) U.S. Cl. ..... 114/362

(58) Field of Classification Search ..... 114/343, 114/361–364; 182/194
See application file for complete search history.

(56) References Cited

U.S. PATENT DOCUMENTS

| | | | | |
|---|---|---|---|---|
| 2,758,770 | A | 8/1956 | Wagner | |
| 2,924,291 | A | 2/1960 | Tunstead | |
| 3,078,955 | A | 2/1963 | Rich | |
| 3,169,503 | A | 2/1965 | Lane | |
| 4,157,131 | A | 6/1979 | Bazyk | |
| 4,502,566 | A * | 3/1985 | Wing | 182/214 |
| 4,538,314 | A | 9/1985 | Baranowski | |
| 4,548,294 | A | 10/1985 | Ruda et al. | |
| 4,613,013 | A | 9/1986 | Watling | |
| 5,704,447 | A | 1/1998 | Doyle | |
| 7,585,197 | B1 | 9/2009 | Merten | |
| 2007/0186840 | A1 | 8/2007 | Dvorak | |
| 2008/0302603 | A1 * | 12/2008 | Madison | 182/106 |
| 2009/0260560 | A1 * | 10/2009 | Plante et al. | 114/343 |

OTHER PUBLICATIONS

U.S. Appl. No. 12/924,643, C.D. Chinn.

* cited by examiner

*Primary Examiner* — Daniel Venne

(57) ABSTRACT

A boarding ladder, designed for dock access, which may be securely and non-invasively mounted onto a sailboat's toe-rail. The invention utilizes a continuous hook mechanism to bear the user's weight, and attachment mechanisms to retain the hook in place. The invention offers the advantages of being sturdy, yet readily removable, and compact for easy stowage.

8 Claims, 7 Drawing Sheets

TOE-RAIL MOUNTED BOARDING LADDER FOR SAILBOATS

U.S. Classification 114/362, Boat Boarding Aids.
The following is a list of prior art cited herein:

| | | |
|---|---|---|
| U.S. Pat.No. 2,758,770 | Aug. 14, 1956 | C. D. Wagner |
| U.S. Pat.No. 2,924,291 | Feb. 9, 1960 | C. W. Tunstead |
| U.S. Pat.No. 3,078,955 | Feb. 26, 1963 | H. B. Rich |
| U.S. Pat.No. 3,149,503 | Feb. 16, 1965 | F. B. Lane |
| U.S. Pat.No. 4,157,131 | Jun. 5, 1979 | R. J. Bazyk |
| U.S. Pat.No. 4,538,314 | Sep. 3, 1985 | K. M. Baranowski |
| U.S. Pat.No. 4,548,294 | Oct. 22, 1985 | J. Ruda, et al. |
| U.S. Pat.No. 4,613,013 | Sep. 23, 1986 | N. C. Watling |
| U.S. Pat.No. 5,704,447 | Jan. 6, 1988 | D. A. Doyle |
| U.S. Pat. App. Pub. 2007/0186840 A1 | Aug. 16, 2007 | R. Dvorak |
| U.S. Pat. No. 7,585,197 | Sep. 8, 2009 | C. W. Merten |
| U.S. Pat. No. 8,297,215 | Oct. 30, 2012 | C. D. Chinn |

FIELD OF INVENTION

The present invention generally relates to boat boarding aids, and more particularly, to removable ladders for boarding from, or disembarking to, a dock. Specifically, the present invention introduces a compact, non-invasively mounted, dock access boarding ladder, which may be secured to the toe-rail of many modern sailboats.

BACKGROUND OF THE INVENTION

Leisure sailing has never been more affordable and comfortable, as designers have refined composite construction techniques to craft sailboats with ever more spacious and luxurious cabins. But as cabin headroom has grown, so too has freeboard, the height of the main deck over the waterline. Higher freeboard is problematic in only one significant way; it can be much harder to climb aboard.

From floating dock to main deck, many larger sailboats now require a climb of over 30 inches, the functional equivalent of stepping onto a moving dining room table. While this is presumably effortless for the captain and experienced crew, with a pitching deck and a water gap, this climb may be a daunting task for younger, older, or less athletic passengers.

Surprisingly, to the present day, the vast majority of recreational sailors rely on stairs or ladders placed on the dock next to their boat. Again, while effective for the crew, many less experienced users find that these devices present the distinct disadvantage of requiring the user to climb to height before taking the most dangerous step, the step onto the rocking boat.

In addition, dock stairs are not truly portable, and cannot readily be carried when visiting another port. As such, many recreational sailors use dock stairs at their home berth, yet carry a folding ladder for use in other ports. This redundancy is less than ideal, as most folding ladders are bulky and require significant storage space, and all are difficult or impossible to use while docking or casting off with mooring lines in hand.

Dock access ladders mounted onto sailboats would seem to be the ideal solution, but in fact, none has achieved any significant measure of market success. Most designs attach a removable ladder to a permanent mounting, screwed or bolted directly into the fiberglass deck or hull. While such mounting is certainly possible, most knowledgeable boat owners do not take drilling lightly, as water infiltration into the fiberglass laminated balsa wood core can cause extremely expensive structural damage.

Hook type ladders, requiring no permanent mounting (hereinafter "hook-on" ladders), are popular for use in small leisure motorboats, which have substantial gunwales and sit close to the water. But unlike most motorboats, modern sailboats have very short gunwales and high freeboard, making hook-on ladders for sailboats virtually non-existent in art.

Most modern sailboat gunwales, having lost the need to actually mount guns, are more commonly known as "toe-rails," and are reduced in size to a mere inch or two, to serve the function of preventing sailors' feet from slipping overboard. Modern toe-rails are commonly made of extruded aluminum or wood, or may be integrally molded into the deck with fiberglass composites.

These small modern toe-rails have heretofore been considered unsuitable for mounting dock access boarding ladders. As discussed in prior art below, a sailboat's fore and aft rocking motion tends to cause a ladder's hooks to "walk" over the short toe-rail, casting the user into the water. Obviously, next to a dock, this condition can be fatal.

In brief, the present invention is a secure, toe-rail mounted, dock access boarding ladder for sailboats. The invention is designed to eliminate the dangerous condition of a ladder "walking" overboard, by introducing a channel the width of the invention, serving as a single, continuous hook, locked in place onto a toe-rail. These improvements allow for a compact, removable, boarding ladder for sailboats, without the need for invasive permanent mounting.

DISCUSSION OF PRIOR ART

U.S. Pat. No. 8,297,215, by this applicant, sets forth a stanchion-mounted dock access ladder for sailboats. Said patent discusses the advantages and disadvantages of prior art in dock mounted stairs and ladders, and the few permanently mounted boarding ladders available for sailboats, and is incorporated herein by reference. As the present application goes further to set forth a novel, non-invasively mounted, dock access ladder for sailboats, the prior art specific to hook-on ladders is discussed herein.

The use of hook-on ladders on sailing ships likely dates to antiquity, as a vast improvement over straight ladders on rolling seas. More modernly, prior art reveals a number of hook-on boarding ladders that have the advantage of being removable without permanent mounting. Some ladders feature fixed hooks, like U.S. Pat. Nos. 2,924,291 (Tunstead), 3,149,503 (Lane), 4,538,314 (Baranowski), and 4,613,013 (Watling), while others feature rotating or folding hooks, like U.S. Pat. Nos. 2,758,770 (Wagner), 3,078,955 (Rich), and 4,157,131 (Bazyk). Whether fixed or folding, all devices utilize two hooks mounted at or near the top of each vertical ladder riser.

Each of these hook-on designs are suitable for boats with pronounced gunwales, and which sit close to the water, such as leisure motorboats or ski boats. In fact, each is designed for egress to, and ingress from the water, more commonly known as swim ladders. As such, ladder instability is not a major concern.

Dock access ladders, on the other hand, present a much greater risk of injury or death; a user who is cast into the water may be crushed between the dock and the boat's hull. None of the aforementioned designs contemplate use for dock access, and even modified as would be necessary for dock access, none of these hook-on designs would be suitable for a sailboat, for lack of any means to secure their hooks in place.

Like terrestrial ladders, nautical ladders are readily destabilized by lateral motion. On land, it is well known that a user's oscillating weight distribution can cause the feet of the ladder to "walk" outward to an untenable angle, causing catastrophic loss of support. Similarly, at sea, a user's weight, in conjunction with lateral oscillations caused by movement of the boat, can cause a ladder's hooks to "walk" overboard, generally causing sudden and catastrophic loss of support in one hook, and almost certainly causing a fall.

As most modern sailboats have high freeboard and very short toe-rails, in a ladder mounted thereon, a fore and aft rocking motion of the boat causes the ladder to act as a lever, alternately lifting each ladder hook-s off the deck, and potentially "walking" a ladder hook over the toe-rail.

The danger to a user in walking a ladder overboard is substantial. Beyond the ignominy of an unexpected swim, the swimmer may be struck by the falling ladder, or worse yet, may be crushed between the hull and the dock.

So great is this risk of harm that, as far as is known, there is only one ladder currently manufactured that is designed to hook onto a toe-rail, a swim ladder from Australia. This ladder suffers the exact same risk of walking overboard, but Australia favors the legal doctrine of assumption of the risk. This applicant would not recommend this ladder's use, except on very mild seas.

More prudently, U.S. Pat. No. 4,548,294 (Ruda) prevents a boarding ladder from walking overboard by hooking it between a pontoon boat's existing railing supports. While this design is simple and effective, it would not be suitable for most sailboats, as the distance between sailboat stanchions typically exceeds 6 feet. This would not yield a compact ladder.

One manufacturer utilizes the specific hardware built onto some sailboats, offering a stable boarding ladder that attaches onto an extruded aluminum genoa fairlead track. While this design effectively eliminates walking, this ladder is suitable only for the minority of sailboats with a suitable aluminum genoa track mounted directly onto the toe-rail.

U.S. Pat. No. 3,149,503 (Lane) takes an alternative approach, avoiding the walking movement of the ladder by hooking the ladder around a mooring cleat. While this solution works, boat manufacturers do not mount cleats at a fixed distance from the toe-rail, and as such, the device would have to be custom built to each boat.

U.S. Patent Application Publication Number 2007/0186840 A1 (Dvorak) resolves the issue of non-standard cleat placement by using a rope around the cleat. While this solution is infinitely adjustable, this boarding platform more closely approximates the movement of rope ladders, a problem rather tenuously resolved with suction cups.

Many manufacturers offer removable rope ladders, some with solid rungs, which may be hooked onto a variety of fixtures on a boat. These venerable designs are excellent as emergency man-overboard ladders, and there are some modern iterations such as U.S. Pat. Nos. 5,704,447 (Doyle) and 7,585,197 (Merten). However, by the nature of their design, rope ladders are inherently unstable.

To the present, there has been no sturdy boarding ladder that can securely hook onto a sailboat's toe-rail without permanent mounting.

SUMMARY OF THE INVENTION

The present invention is a compact, dock access ladder that integrates two primary improvements. First, the present invention utilizes a channel as a single, continuous hook over the full width of the ladder, which assures that the hook does not walk over the toe-rail in normal use. Second, the present invention utilizes a non-invasive attachment mechanism that affixes the hook to the toe-rail, but may be released to allow removal of the ladder.

Further, by resting directly over a toe-rail, the top surface of the continuous hook serves as the upper step of the boarding ladder. In conjunction with a folding lower step, this unique configuration minimizes the size of the invention, rendering it considerably more compact and stowable than rigid boarding ladders in prior art.

Taken as a whole, the present invention may be summarized as a compact, non-invasively mounted, dock access boarding ladder, which may be secured to the toe-rail of many modern sailboats.

DRAWINGS

Figures

The drawings herein depict three of many possible embodiments of the invention. For clarity, a partial view of a sailboat is included in most drawings to illustrate the placement and orientation of the invention. All identical parts are identified by the same reference numbers herein. As all embodiments are bilaterally symmetrical, some parts may be identified by reference numbers on one side only.

LIST OF REFERENCE NUMBERS

Figure 1:
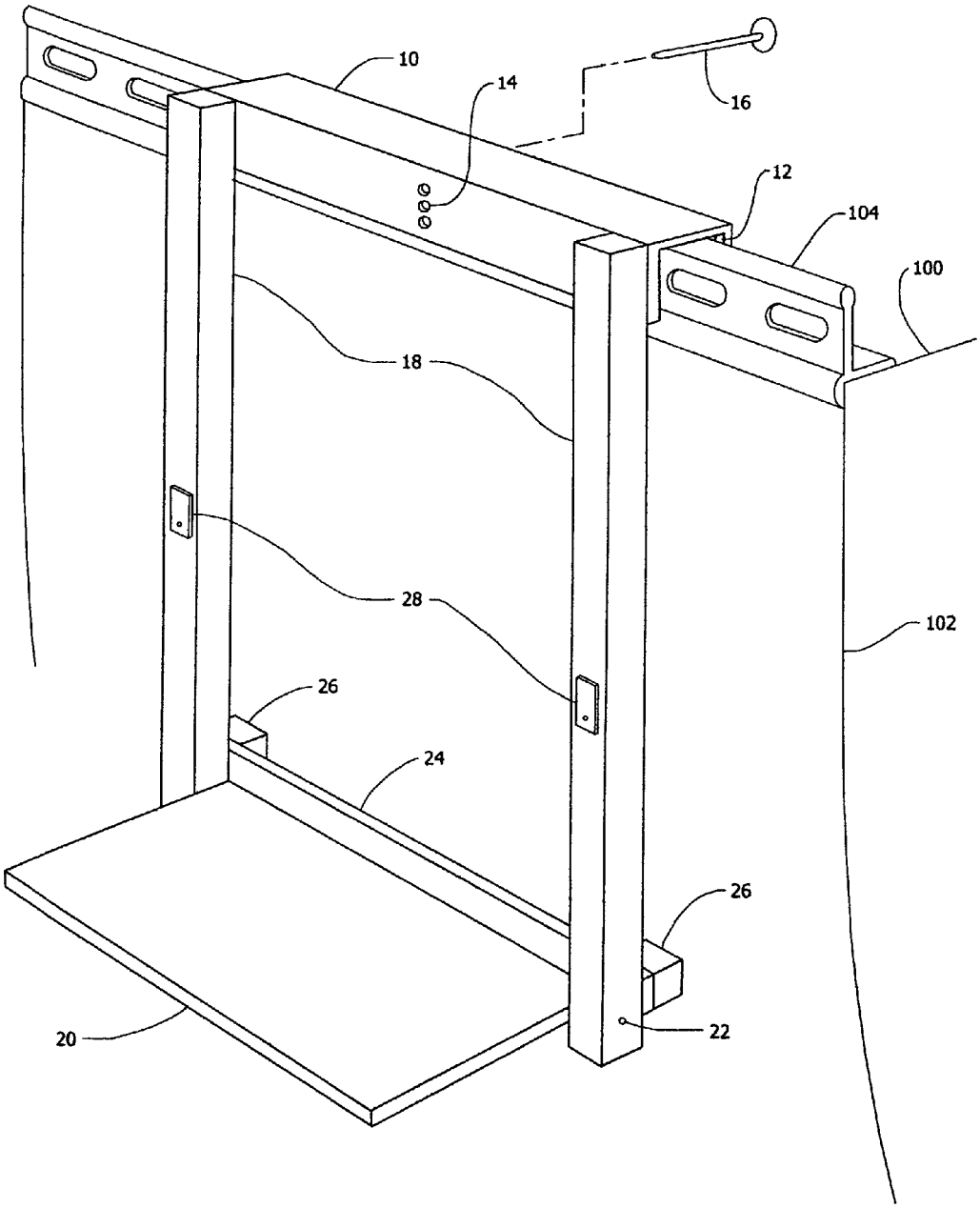
FIG. 1 is a perspective view of the first embodiment, on a slotted, extruded aluminum toe-rail of a sailboat, ready for attachment with a locking ball-detent pin.
Figure 2:
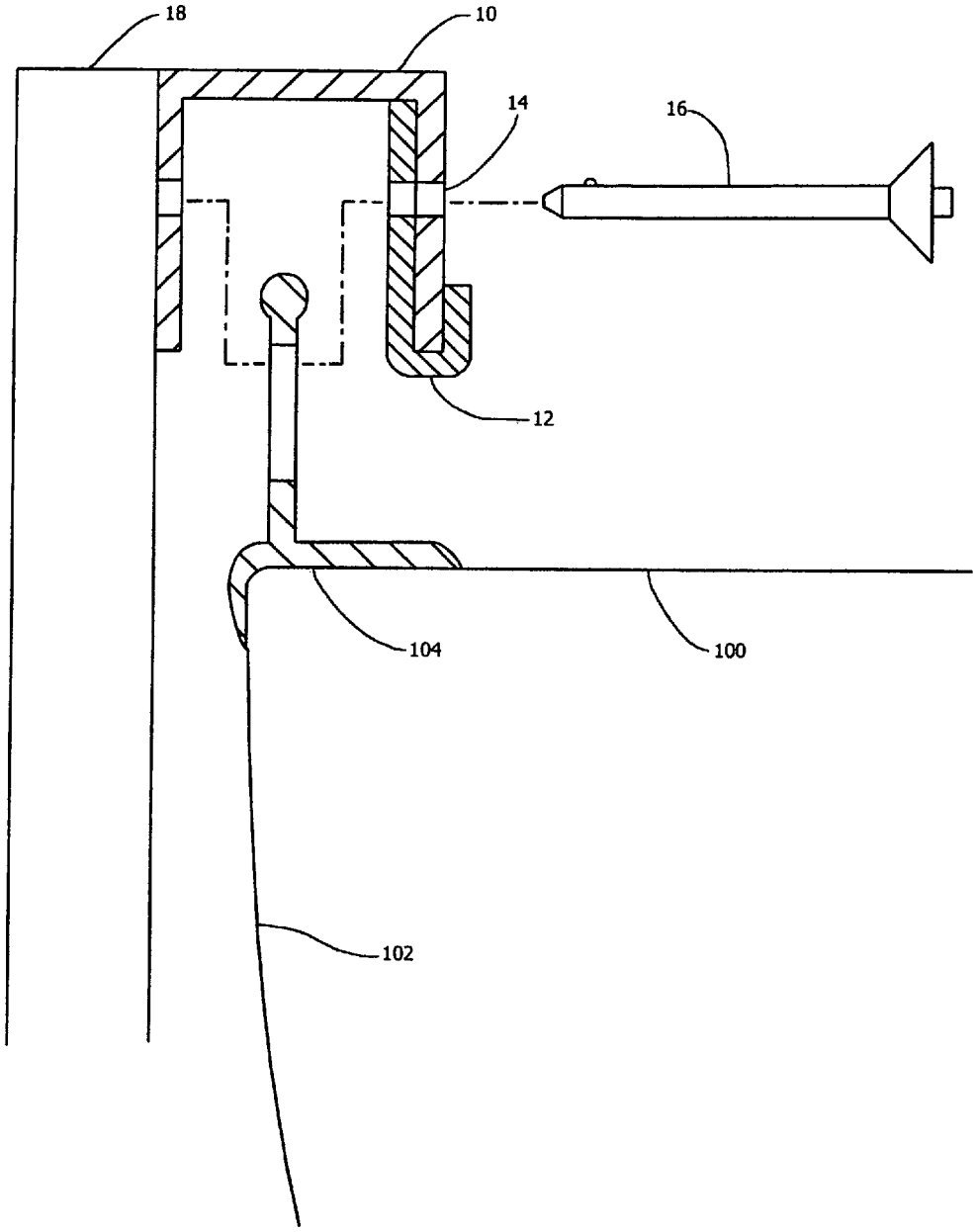
FIG. 2 is a partial sectional view of the first embodiment, sectioned at the locking ball-detent pin.
Figure 3:
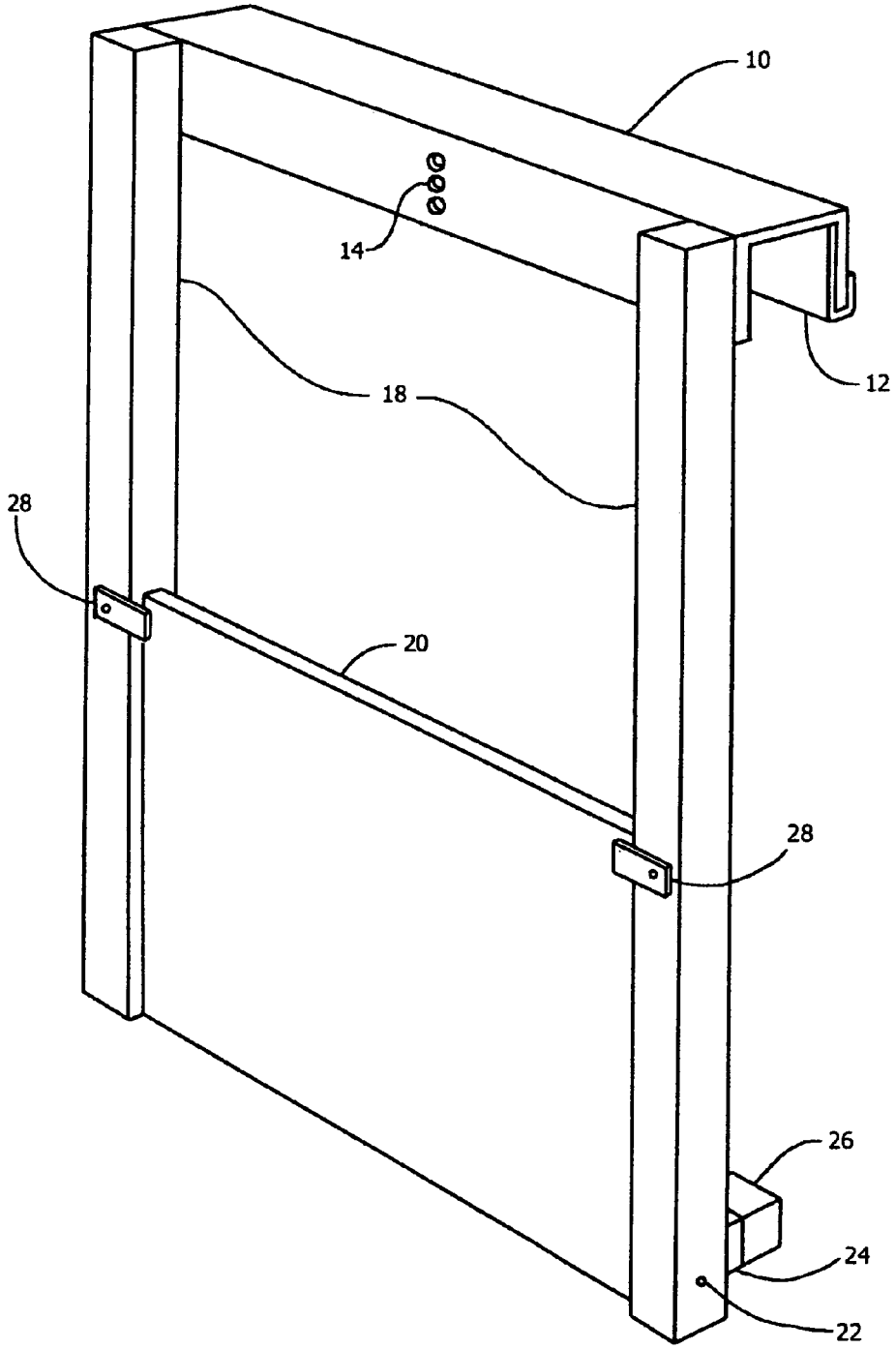
FIG. 3 is a perspective view of the first embodiment, detached and folded for storage.

The First Embodiment—FIGS. 1 through 3

Parts of the First Embodiment

10 continuous hook
12 elastomer pad
14 series of through-holes
16 locking ball-detent pin
18 ladder risers
20 lower step
22 hinge pin
24 toe kick
26 elastomer bumpers
28 rotating latches Select Parts of a Typical Sailboat with an Aluminum Toe-Rail

100 deck
102 hull
104 extruded aluminum toe-rail

Figure 4:
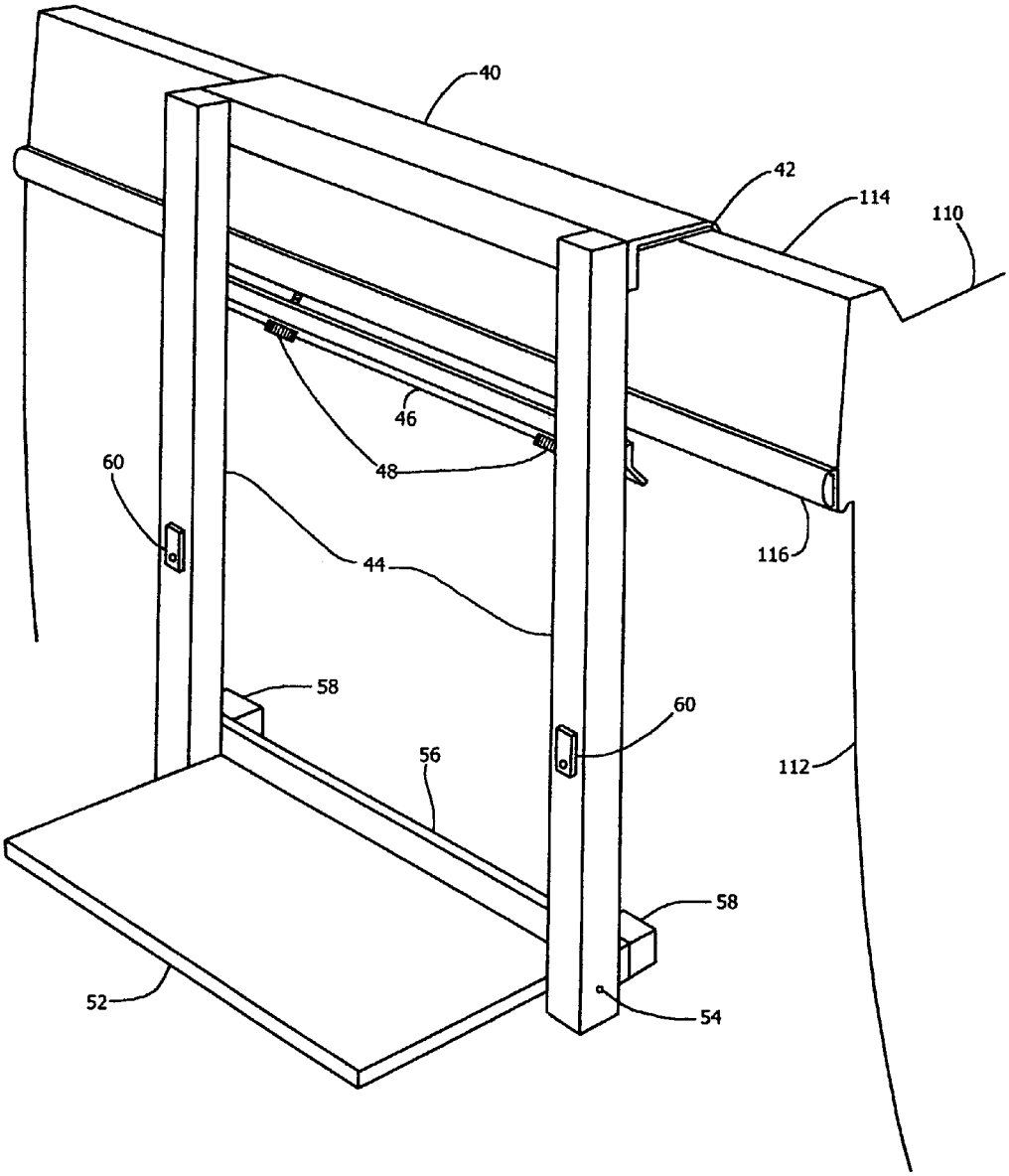
FIG. 4 is a perspective view of the second embodiment, attached to a fiberglass composite toe-rail and rub-rail of a sailboat.
Figure 5:
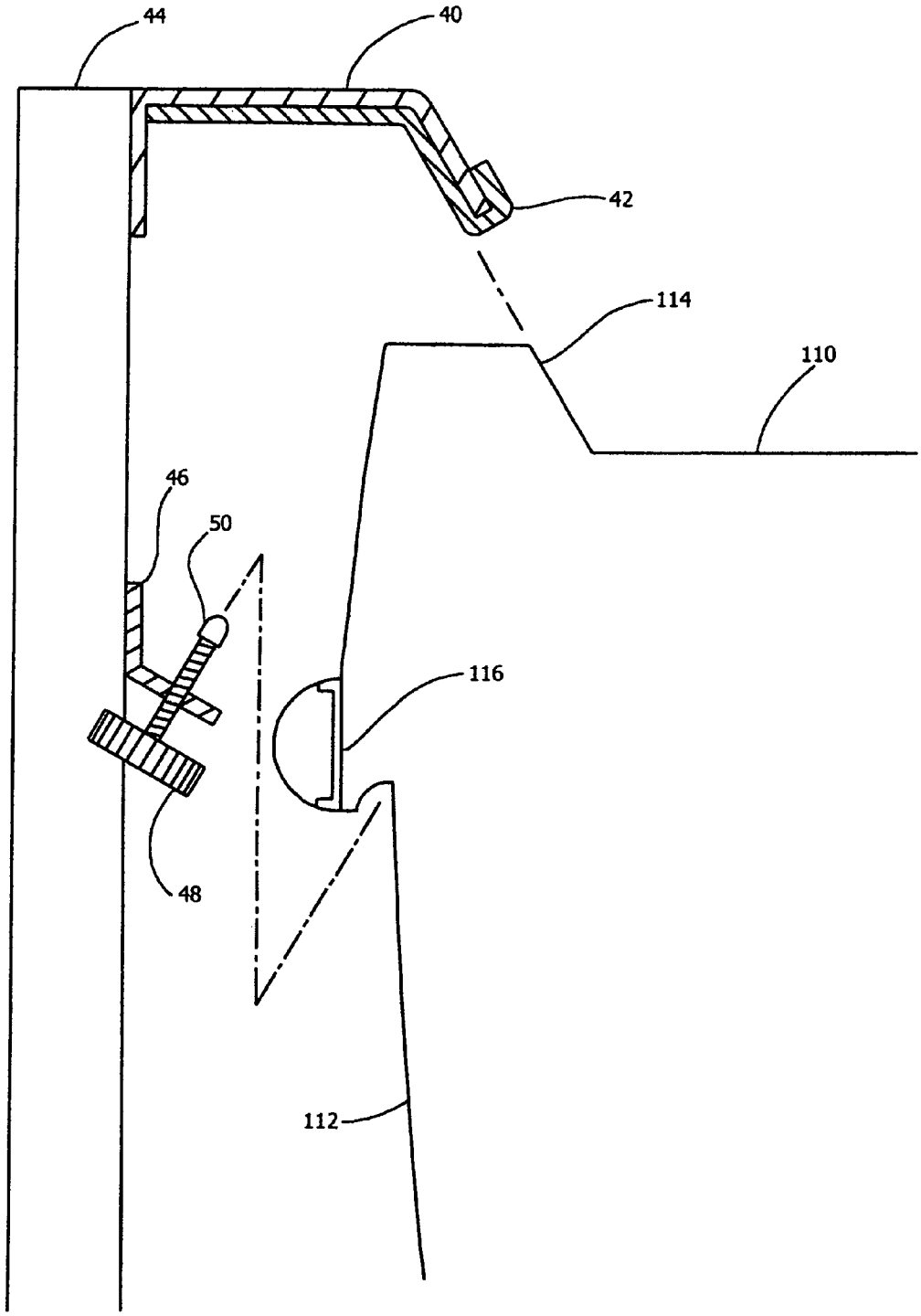
FIG. 5 is a partial sectional view of the second embodiment, sectioned at one of the two thumb-screw assemblies.

The Second Embodiment—FIGS. 4 & 5

Figure 6:
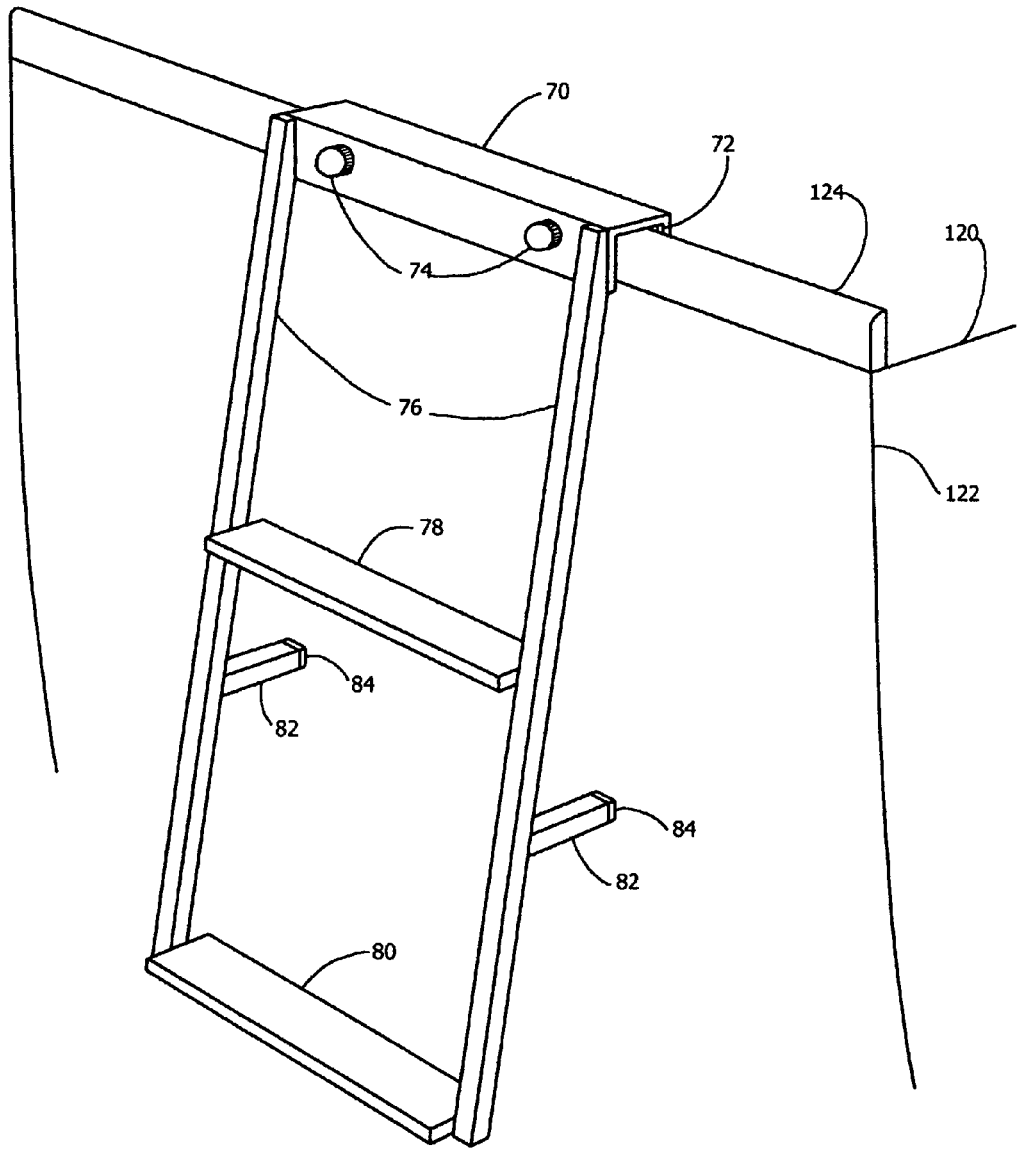
FIG. 6 is a perspective view of the third embodiment, attached to a wooden toe-rail of a sailboat.
Figure 7:
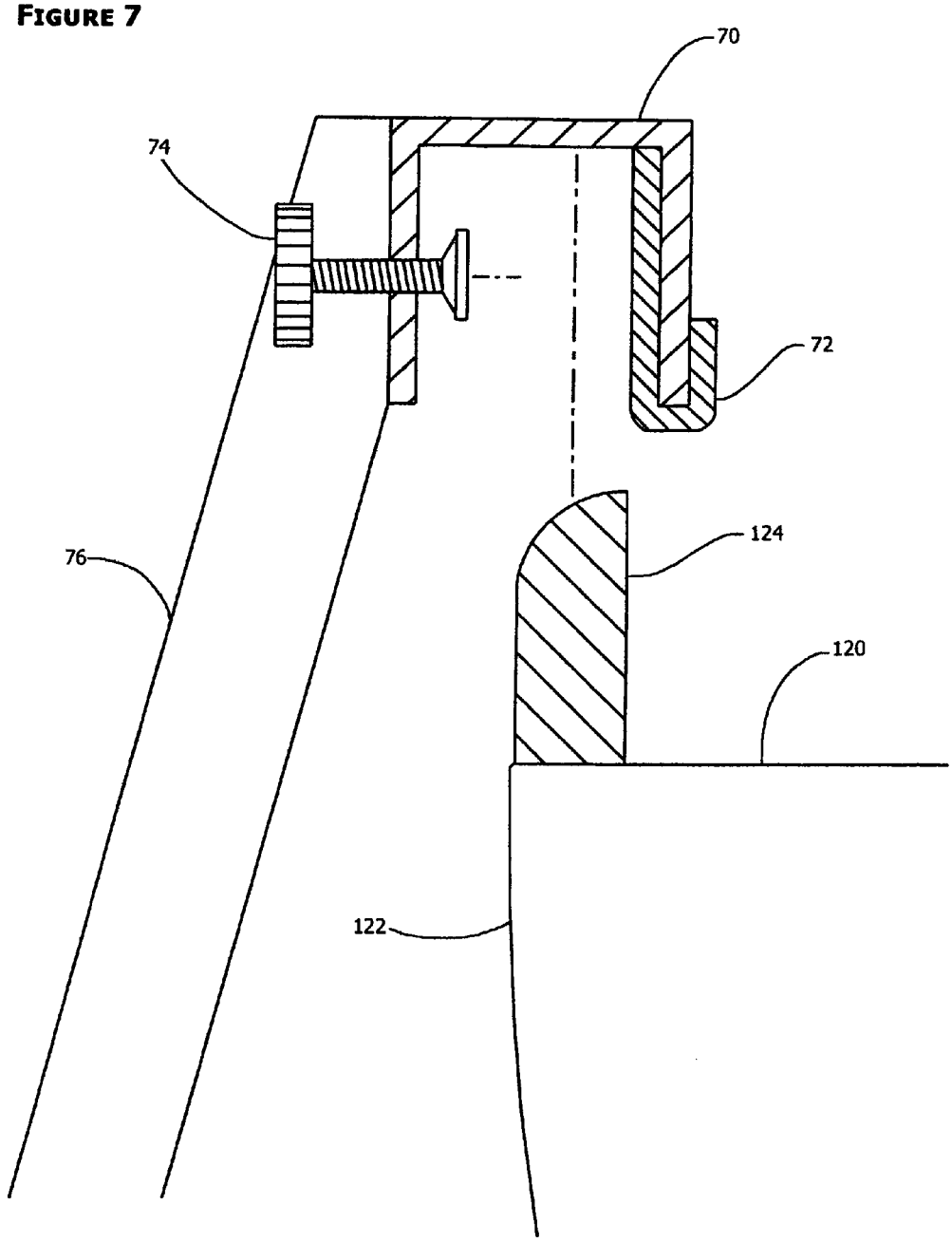
FIG. 7 is a partial sectional view of the third embodiment, sectioned at one of the two thumb-screw assemblies.

Parts of the Second Embodiment
40 continuous hook
42 elastomer pad
44 ladder risers
46 mounting bracket for thumb-screw assemblies
48 thumb-screw assemblies
50 elastomer thumb-screw feet
52 lower step
54 hinge pin
56 toe kick
58 elastomer bumpers
60 latches
Select Parts of a Typical Sailboat with a Fiberglass Toe-Rail
110 deck
112 hull
114 fiberglass toe-rail
116 vinyl and aluminum rub-rail The Third Embodiment—FIGS. 6 & 7

Parts of the Third Embodiment
70 continuous hook
72 elastomer pad
74 thumb-screw, swivel foot, and elastomer pad assemblies
76 ladder risers
78 middle step
80 lower step
82 ladder offset legs
84 elastomer leg bumpers
Select Parts of a Typical Sailboat with a Wood Toe-Rail
120 deck
122 hull
124 wood toe-rail

DESCRIPTIONS AND OPERATIONS

FIG. 1, is a perspective view of the first embodiment, attached to a slotted, extruded aluminum toe-rail of a sailboat. For clarity, a partial view of a boat is included to illustrate the orientation of the invention.

An inverted, substantially "U" shaped channel forms a continuous hook 10 the full width of the invention, and the upper surface forms the top step of a ladder. An elastomer pad 12 is attached to the inboard bottom edge and the inboard inside face of the continuous hook 10, such that the hook 10 does not wear on an extruded aluminum toe-rail 104 when attached thereto.

A vertical series of horizontally drilled holes 14 are made transversely through the center of both faces of the hook 10 and the elastomer pad 12, such that a locking ball-detent pin 16 may be inserted through the inboard hole 14, through a slot in the extruded aluminum toe-rail 104, and through the outboard side of the hole 14, securely locking the invention in place in a non-invasive manner.

Two vertical ladder risers 18 are welded to the outboard face of the hook 10 such that they project downward. An outwardly projecting lower step 20 is attached between the lower ends of the ladder risers 18 by a hinge pin 22. A toe kick 24 is welded to the inboard side of both ladder risers 18, immediately above the lower step 20, to prevent over-rotation of the step 20, and to provide tactile feedback for users. Two elastomer bumpers 26 are attached to the toe kick 24, on the fore and aft ends of the inboard side, to prevent wear on the hull 102. Two rotating latches 28 are attached, one to the outboard face of each ladder riser 18, such that they may retain the lower step 20 when in the folded position.

Affixed in place with the continuous hook 10 and ball-detent pin 16, and with the lower step 20 deployed, the invention is designed to transfer a user's weight to the deck 100 through the flange of the toe-rail 104, with virtually no lateral or torsional force on the toe-rail 104. As such, this embodiment provides a safe and secure, non-invasively mounted boarding ladder.

Affixed as such, the top surface of the continuous hook 10 and the lower step 20 form a two step ladder, projecting outward in the manner of stairs. This cantilevered lower step 20 configuration is preferred by most users, and users generally find it comfortable with a distance of 15 inches between the top step hook 10 and the lower step 20. As such, this embodiment would be suitable for most sailboats in the 30 to 50 foot range, which have aluminum toe-rails.

While the drawing does not depict stanchions or lifelines, for optimal safety, the invention is best affixed near a stanchion, so that it may be used as a handrail for boarding and disembarking. While it is ideal to use the invention with lifelines lowered, many experienced sailors are accustomed to stepping over lifelines to board, and the invention may be used as such.

FIG. 2 is a partial sectional view of the first embodiment, sectioned at the locking ball-detent pin 16. For clarity, a partial view of a boat is included to illustrate the orientation of the invention.

The elastomer pad 12 is bonded to the inboard bottom edge and the inside face of the continuous hook 10 such that, when attached to the toe-rail 104, the pad 12 rests on the inboard toe-rail's 104 flange, without bearing on the top of the toe-rail 104. As such, when attached and in use, the weight of a user is placed entirely upon the toe-rail 104 flange, at the deck 100 and hull 102 joint, one of the strongest parts of a boat. To affix the invention in place, the locking ball-detent pin 16 is inserted through the inboard side of one hole 14 (only one shown in this view for clarity) in the hook 10 and pad 12, through a slot in the toe-rail 104, and through the outboard side of the hook 10. So assembled, the invention prevents fore and aft rocking of the ladder assembly, and the ladder is prevented from walking overboard, yielding a safe and secure boarding ladder.

Note that if the ladder is accidentally used with the pin 16 unattached, the continuous nature of the hook 10 makes it difficult for the ladder to walk over the toe-rail 104, as the hook 10 will tend to reseat on the toe-rail 104 even after very significant rocking. While such use is strongly discouraged as considerably less stable, the continuous nature of the hook 10 provides an added measure of safety in the event the pin 16 is inadvertently left out.

FIG. 3 is a perspective view of the first embodiment folded for storage. Detachment of the invention is the reverse of installation. In addition, the lower step 20 is rotated upwardly around the hinge pin 22, such that it fits between the ladder risers 18. The two latches 28 are rotated inwardly to hold the lower step 20 in place.

Note that by design, the size and number of parts of the invention are minimized in two significant ways; 1) by utilizing the top surface of the continuous hook 10 as the upper step of the ladder, and, 2) by attaching the hook 10 at the toe-rail, the very closest projection to the edge of the deck. With the lower step 20 folded, the invention measures approximately 12" by 16" by 4", and is considerably more compact and stowable than boarding ladders in prior art.

FIG. 4 is a perspective view of the second embodiment, attached to a sailboat with a fiberglass composite toe-rail and rub-rail. For clarity, a partial view of the boat is included to illustrate the orientation of the invention.

An inverted, substantially "U" shaped channel forms a continuous hook 40 the full width of the invention, and the upper surface forms the top step of a ladder. An elastomer pad 42 is attached to the inboard bottom edge and the top and inboard inside faces of the continuous hook 40, such that the hook 40 does not wear on a fiberglass composite toe-rail 114 when attached thereto.

Two vertical ladder risers 44 are welded to the outboard face of the hook 40 such that they project downward. A mounting bracket 46 is drilled and tapped for two thumb-screw assemblies 48, and attached to the inboard faces of the ladder risers 44 such that the thumb-screw assemblies 48 may be tightened upward and inward to protrude into a space that exists between a sailboat's vinyl and aluminum rub-rail 116 and the sailboat's hull 112. By placing the hook 40 and pad 42 assembly over the toe-rail, and by tightening the thumb-screw assemblies 48, the invention may be securely and non-invasively locked in place.

The lower step assembly of the second embodiment is identical to the first embodiment. An outwardly projecting lower step 52 is attached between the lower ends of the ladder risers 44 by a hinge pin 54. A toe kick 56 is welded to the inboard side of both ladder risers 44, immediately above the lower step 52, to prevent over-rotation of the step 52, and to provide tactile feedback for users. Two elastomer bumpers 58 are attached to the toe kick 56, on the fore and aft ends of the inboard side, to prevent wear on the hull 112. Two rotating latches 60 are attached, one to the outboard face of each ladder riser 44, such that they may retain the lower step 52 when in the folded position.

Affixed in place with the continuous hook 40 and thumb-screws 48, and with the lower step 52 deployed, the invention is designed to transfer a user's weight to the integrated fiberglass composite toe-rail 114 and deck 110 with little or no lateral force on the rub-rail assembly 116. As such, this embodiment provides a safe and secure, non-invasively mounted, boarding ladder.

Affixed as such, the top face of the continuous hook 40 and the lower step 52 form a two step ladder, projecting outward in the manner of stairs. This cantilevered lower step 52 configuration is preferred by most users, and users generally find it comfortable with a distance of 15 inches between the top step hook 40 and the lower step 52. As such, this embodiment would be suitable for many sailboats in the 30 to 50 foot range that utilize a similar integrated fiberglass composite toe-rail 114 and rub-rail 116 configuration.

While the drawing does not depict stanchions or lifelines, for optimal safety, the invention is best affixed near a stanchion, so that it may be used as a handrail for boarding and disembarking. While it is ideal to use the invention with lifelines lowered, many experienced sailors are accustomed to stepping over lifelines to board, and the invention may be used as such.

Detachment of the invention is the reverse of installation. While not depicted, note that the second embodiment may be folded and stowed like the first embodiment, and the depictions, descriptions and operations of FIG. 3 are incorporated herein by reference.

FIG. 5, is a partial sectional view of the second embodiment, sectioned at one of the two thumb-screw assemblies 48. For clarity, a partial view of a sailboat is included to illustrate the orientation of the invention.

The continuous hook 40 and elastomer pad 42 are formed and attached, such that when placed on the fiberglass composite toe-rail 114, the hook and pad assembly 40 & 42 rest on the top and inboard surfaces of the toe-rail 114 and on the deck 110. As such, when attached and in use, the weight of a user is placed entirely upon the sturdy integrated fiberglass composite toe-rail 114 and deck 110 assembly.

Ladder risers 44 are welded to the outboard face of the hook 40, projecting downward. The mounting bracket 46 is longitudinally bent, and drilled and tapped for two thumb-screw assemblies 48, and attached between the ladder risers 44 on their inboard faces, such that the thumb-screw assemblies 48 may be tightened upward and inward to protrude into the space that exists between a sailboat's vinyl and aluminum rub-rail 116 and the sailboat's hull 112. Elastomer thumb-screw feet 50 are attached to the thumb-screw assemblies 48 to prevent wear on the hull.

With the continuous hook 40 over the toe-rail 114, and the thumb-screw assemblies 48 gently tightened into the gap between the hull 112 and rub-rail 116, the invention is securely affixed for use. So assembled, the invention prevents fore and aft rocking of the ladder assembly, and the ladder is prevented from walking overboard, yielding a safe and secure boarding ladder.

Note that if the ladder is accidentally used with the thumb-screw assemblies 48 untightened, the continuous nature of the hook 40 makes it difficult for the ladder to walk over the toe-rail 114, as the hook 40 will tend to reseat on the toe-rail 114 even after very significant rocking. While such use is strongly discouraged as considerably less stable, the continuous nature of the hook 40 provides an added measure of safety in the event the thumb-screws 48 are inadvertently left untightened.

FIG. 6 is a perspective view of the third embodiment, attached to a wood toe-rail of a sailboat. For clarity, a partial view of the boat is included to illustrate the orientation of the invention.

An inverted, substantially "U" shaped channel forms a continuous hook 70 the full width of the invention, and the upper surface forms the top step of a ladder. An elastomer pad 72 is attached to the inboard bottom edge and the inside face of the continuous hook 70, such that the hook 70 does not wear on a wood toe-rail 124 when attached thereto.

The outboard face of the hook 70 is drilled and tapped for two thumb-screw, swivel foot and elastomer pad assemblies 74. By placing the hook 70 and pad 72 assembly over the wood toe-rail 124, and by tightening the thumb-screw assemblies 74 against the toe-rail 124, the invention may be securely and non-invasively locked in place.

Two ladder risers 76 are welded to the outboard face of the hook 70 such that they project downward, and project outward at an angle of 15 degrees. A middle step 78 is attached between the ladder risers 76 at their midpoint. A lower step 80 is attached between the ladder risers 76 at their lower end. Two ladder offset legs 82 are attached to the inboard face of the ladder risers 76, and two leg bumpers 84 are attached to the inboard ends of the ladder offset legs 82, such that the ladder risers 76 are held away from the hull 122 at a 15 degree angle.

Affixed in place with the continuous hook 70 and thumb-screws 74, the invention is designed to transfer a user's weight to the deck 120 and toe-rail 124, with insignificant lateral or torsional force on the toe-rail 124. As such, this embodiment provides a safe and secure, non-invasively mounted boarding ladder.

Affixed as such, the top surface of the continuous hook 70 and the middle and lower steps 78 & 80 form a three-step boarding ladder. With a distance of 12 to 14 inches between the steps, this embodiment would be suitable for most sailboats in the 45 to 60 foot range with a similar wood toe-rail configuration.

While the drawing does not depict stanchions or lifelines, for safety, the invention is best placed near a stanchion so that it may be used as a handrail for boarding and disembarking. While it is ideal to use the invention with lifelines lowered, many experienced sailors are accustomed to stepping over lifelines to board, and the invention may be used as such.

FIG. 7 is a partial sectional view of the third embodiment, sectioned at one of the two thumb-screw assemblies 74. For clarity, a partial view of a sailboat is included to illustrate the orientation of the invention.

The elastomer pad 72 is bonded to the inboard bottom edge and the inside face of the continuous hook 70 such that, when installed upon a wood toe-rail 124, the pad 72 rests on the deck 120 of the boat, without bearing on the top of the toe-rail 124. As such, when attached and in use, the weight of a user is placed entirely upon the deck 120 and toe-rail 124, with little lateral or torsional force on the toe-rail 124.

The outboard face of the continuous hook 70 is drilled and tapped for two thumb-screw, swivel foot and elastomer pad assemblies 74. By placing the hook 70 over the wood toe-rail 124, and by tightening the thumb-screw assemblies 74, the invention may be securely affixed to a boat. So affixed, the invention prevents fore and aft rocking of the ladder assembly, and the ladder is prevented from walking overboard, yielding a safe and secure boarding ladder.

Note that if the ladder is accidentally used with the thumb-screw assemblies 74 unattached, the continuous nature of the hook 70 makes it difficult for the ladder to walk over the toe-rail 124, as the hook 70 will tend to reseat on the toe-rail 124 even after very significant rocking. While such use is strongly discouraged as considerably less stable, the continuous nature of the hook 70 provides an added measure of safety in the event the thumb-screws 74 are inadvertently left untightened.

SCOPE AND DEFINITIONS

While many specificities are used throughout this document, and in the drawings and descriptions, these specificities should not be construed as limitations on the scope of the invention, but as exemplifications of the presently preferred embodiments allowable under the claim.

As used throughout, the term "invention" refers not only to the preferred, described or depicted embodiments, but to all alternative embodiments allowable under the claim.

As used throughout, the term "ladder" refers to ladders or stairs, or any combination thereof.

As the invention is primarily designed for sailboats, the term "sailboat" is used throughout. However, said term should not be construed as a limitation on the scope of the invention, but as preferred embodiments allowable under the claim.

Alternative embodiments include, but are not limited to the following. The ladder may fold or not fold, may be made to fold in a different manner, made telescopic or otherwise extensible, made into a swim ladder, made to lock into a folded or unfolded position, made larger or smaller, or made of more or less parts.

The ladder's hook assembly may differ in size, shape, form and function and may be a continuous hook or a plurality of hooks, so long as the function of the hook is to attach the ladder onto a sailboat's toe-rail.

The ladder's attachment assemblies may differ in size, shape, form and function, and may be pins, thumb-screws, cams, clamps, straps, wedges, or other devices, so long as the purpose of such attachment device is to maintain the ladder's hook onto a sailboat's toe-rail.

The ladder may have one riser, or a plurality of risers. The number of steps may differ, and the step assemblies may fold or not fold, may fold in a different manner, may be unfolded by means of a spring, may be made to lock in a folded or unfolded position, may be made telescoping or otherwise extensible, may differ in design and shape, and may project outward like stairs, or downward like rungs in a ladder, or any combination thereof.

The attachment of any and all parts may be accomplished by different means and methods, may be permanently, removably, or adjustably attached, and all parts may be attached at different locations. All parts and materials may differ in size, shape, thickness, composition and number, and parts may be added to and/or removed from the design.

Accordingly, while this invention relates primarily to the functional and aesthetic aspects of non-invasively mounted boarding ladders for sailboats, the scope of the invention shall not be determined by the examples herein stated, as myriad variations are possible within the parameters of the claims of invention.

ADVANTAGES AND CONCLUSIONS

It seems plainly incongruous that most owners of pleasure yachts are forced to rely on cumbersome, non-transportable dock stairs, or awkward folding metal ladders placed on dock. Away from home port, more than a few have been embarrassed to watch their less athletic friends resort to the sit-and-scoot method of boarding.

The subject invention is an easy-to-use, dock access boarding ladder, hooked to, and securely attachable to, the toe-rail of most modern sailboats. Attached in a manner not heretofore considered viable, the invention is unusually compact, yet may readily replace both dock stairs and folding dock ladders.

The three preferred embodiments depicted herein fit most modern sailboats, and each is securely and non-invasively mounted. In use, the ladder's hook transmits virtually all the force of a user's weight directly to the deck near the hull joint, one of the strongest parts of any boat. The invention does not require drilling, structural alteration, or tools.

The invention is extraordinarily stable, as it is held in place by two mechanisms. First, the weight of the user is borne by a single, continuous hook, which is not susceptible to "walking" overboard even in significant fore and aft rocking. As a secondary measure of safety, the continuous hook is secured in place by an attachment mechanism which may be formed of retaining pins, thumb-screws, or other devices.

Mounted and locked in place, the ladder is extremely stable, natural and intuitive. As the ladder moves with the boat, the first step puts the user firmly in synchrony with the boat. The athletically inclined will step on or off in two easy strides, bypassing the top step. More cautious guests will find that the invention's placement near a stanchion offers a secure grip, and may choose to climb on and off facing the ladder.

Experienced crew will find the ladder most advantageous during the casting off and docking procedures. As the ladder sits higher than floating docks, and moves with the boat, crew may help walk the boat out of the berth and readily step aboard. On returning to port, with mooring lines in hand, crew may avoid a precarious leap from deck to dock.

Folding and deploying the ladder is clear, even for first-time users. Both the hook and the attachment mechanisms are simple and apparent, and the lower step is held fast by obvious rotating latches. The ladder may readily be installed from on board, or from the dock.

The invention is remarkably compact and stowable, as the continuous hook is designed to serve as the top step of the ladder. This unique configuration attaches directly to the nearest projection, the toe-rail, and as such, minimizes both the size and the number of parts of the invention. Preferred embodiments fold into a rectangular form as small as 12" by 16" by 4", a size considerably more compact than boarding ladders in prior art.

To this time, modern sailboat owners have lacked a compact, removable, non-invasively mounted, dock access boarding ladder. As revealed herein, the invention, a toe-rail mounted boarding ladder for sailboats, integrates improvements novel in form and function, to produce significant advantages extending beyond all prior art.

The invention claimed is:

1. A boat boarding aid, comprising:

a) a single, continuous, substantially rigid channel, directly engaging a toe-rail of a boat along an entire length of said channel, and b) a ladder, comprising two rigid ladder risers and one or more ladder rungs, with one ladder riser rigidly connected to each end of an outboard flange of said channel, and each said ladder riser of a length shorter than a distance from a top edge of said toe-rail to a deck of a floating dock, and with said ladder projecting downward over a hull of said boat toward said floating dock, whereby, an individual can board said boat from said floating dock by climbing said ladder and stepping onto as deck of said boat, and, whereby, said boarding aid is primarily secured by engaging said channel over said toe-rail, and, whereby, in an event of fore and aft rocking of said boat, or oscillations of said boarding aid, said channel reseats over said toe-rail, reducing a risk of accidental disengagement of said boarding aid, and, whereby, a primary mode of failure in dual hook boarding ladders is avoided, and, whereby, an individual can engage said boarding aid at any desired location along said toe-rail, and, whereby, an individual can engage said boarding aid to said toe-rail at a location adjacent a stanchion, allowing a convenient hand-grip for boarding, and, whereby, said boarding aid is both detachable and compact for easy storage.

2. A boat boarding aid as recited in claim 1, also comprising:

a) a series of holes, each hole drilled transversely through said outboard flange and an inboard flange of said channel, such that a retaining pin can be passed through an aligned pair of holes through both said flanges, and, b) said retaining pin, of a length to extend through both said flanges, whereby, an individual engages said channel over a slotted aluminum toe-rail, selects one aligned pair of holes corresponding to one slot in said slotted aluminum toe-rail, and passes said retaining pin through one said flange, through said slot in said toe-rail, and through the other said flange, whereby, said boarding aid is primarily secured to said toe-rail by said channel, and is secondarily secured to said toe-rail by said retaining pin, and, whereby, said retaining pin limits both upward and longitudinal movement of said channel, and, whereby, said boarding aid is stable, and moves in conjunction with said boat, and, whereby, said boarding aid can be secured and detached manually, without tools, and, whereby, said boarding aid avoids invasive attachment mechanisms and through-holes on said boat, and, whereby, said boarding ladder can be doubly secured to most boats with slotted aluminum toe-rails.

3. A boat boarding aid as recited in claim 1, also comprising one or more manually-activated clamping mechanisms, attached to said outboard flange, and acting in opposition to an outboard face of said inboard flange, whereby, an individual engages said channel over said toe-rail, engages said clamping mechanisms to press against said toe-rail, and causes said toe-rail to be secured to said outboard face of said inboard flange, and, whereby, said boarding aid is primarily secured to said toe-rail by said channel, and is secondarily secured to said toe-rail by said clamping mechanisms, and, whereby, said clamping mechanisms resist both upward and longitudinal movement of said channel, and, whereby, said boarding aid is stable, and moves in conjunction with said boat, and, whereby, said boarding aid can be secured and detached manually, without tools, and, whereby, said boarding aid avoids invasive attachment mechanisms and through-holes on said boat, and, whereby, said boarding aid can be doubly secured to many boats with wood or non-slotted aluminum toe-rails.

4. A boat boarding aid as recited in claim 1, also comprising:

a) an elongate member attached transversely between said ladder risers, at a distance from a top of said channel slightly greater than a distance from a top edge of said toe-rail to a bottom of a rub-rail on said boat, and, b) attached to said elongate member, one or more manually-activated protrusive clamping mechanisms, acting in opposition to a bottom edge and/or an outboard face of an inboard flange, whereby, an individual engages said channel over said toe-rail, engages said protrusive clamping mechanisms to extend into a gap at said, bottom of said rub-rail, or to press against said bottom of said rub-rail, and causes said toe-rail to be secured to said outboard face of said inboard flange, and, whereby, said boarding aid is primarily secured to said toe-rail by said channel, and is secondarily secured to said toe-rail by said protrusive clamping mechanisms, and, whereby, said protrusive clamping mechanisms prevent both upward and longitudinal movement of said channel, and, whereby, said boarding aid is stable, and moves in conjunction with said boat, and, whereby, said boarding aid can be secured and detached manually, without tools, and, whereby, said boarding aid avoids invasive attachment mechanisms and through-holes on said boat, and, whereby, said boarding aid can be doubly secured to most boats with both a toe-rail and a rub-rail.

5. A boat boarding aid as recited in claim 1, wherein a top face of a web of said channel serves as a top step of said boarding aid, whereby said boarding aid is compact for storage.

6. A boat boarding aid as recited in claim 1, wherein said ladder rungs are connected to said ladder risers by a hinge mechanism, whereby said rungs can unfold outward into a substantially rigid stair configuration, allowing an individual to stand on the rungs with his or her foot parallel to said boat's hull, and, whereby said boarding aid can be folded to be compact for storage.

7. A boat boarding aid as recited in claim 1, wherein a height of an inboard flange of said channel is slightly greater than a height of said boat's toe-rail, whereby said inboard flange primarily transfers a force of a user's weight downward to said deck of said boat, and whereby lateral and torsional forces on said toe-rail are minimized.

8. A boat boarding aid, comprising:

a) one or more substantially rigid hooks, directly engaging a toe-rail of a boat, and, b) a ladder, comprising two rigid ladder risers and one or more ladder rungs, each said ladder riser directly and rigidly connected to said hooks, and each said ladder riser of a length shorter than a distance from a top edge of said toe-rail to a deck of a floating dock, and with said ladder projecting downward over a hull of said boat toward said floating dock, and, c) an elongate member attached transversely between said ladder risers, at a distance from a top of said hooks slightly greater than a distance from said top edge of said toe-rail to a bottom of a rub-rail on said boat, and, d) attached to said elongate member, one or more protrusive clamping mechanisms, acting in opposition to a bottom edge and/or an inside face of said hooks, whereby, an individual can board said boat from said floating dock by climbing said ladder and stepping onto a deck of said boat, and, whereby, said boarding aid is primarily secured by engaging said hooks over said toe-rail, and, whereby, an individual can engage said protrusive mechanisms to extend into a gap at said bottom of said rub-rail, or to press against said bottom of said rub-rail, causing said toe-rail to be secured to said hooks, and, whereby, said protrusive mechanisms prevent both upward and longitudinal movement of said hooks, and, whereby, said boarding aid is stable, and moves in conjunction with said boat, and, whereby, said boarding aid is primarily secured to said toe-rail by said hooks, and is secondarily secured to said toe-rail by said protrusive mechanisms, and, whereby, an individual can engage said boarding aid at any desired location along said toe-rail, and, whereby, an individual can engage said boarding aid to said toe-rail at a location adjacent a stanchion, allowing a convenient hand-grip for boarding, and, whereby, said boarding aid is both detachable and compact for easy storage, and, whereby, said boarding aid can be secured and detached manually, without tools, and, whereby, said boarding aid avoids invasive attachment mechanisms and through- holes on said boat, and, whereby, said boarding aid can be doubly secured to most boats with both a toe-rail and a rub-rail.

* * * * *